US006721534B2

(12) United States Patent
Takahashi

(10) Patent No.: US 6,721,534 B2
(45) Date of Patent: Apr. 13, 2004

(54) IMAGE FORMATION METHOD AND IMAGE FORMATION APPARATUS

(75) Inventor: Tomoko Takahashi, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/163,512

(22) Filed: Jun. 7, 2002

(65) Prior Publication Data

US 2003/0031490 A1 Feb. 13, 2003

(30) Foreign Application Priority Data

Jun. 8, 2001 (JP) ..... 2001-174589
Jul. 2, 2001 (JP) ..... 2001-201509

(51) Int. Cl.[7] ..... G03G 21/10; G03G 15/01
(52) U.S. Cl. ..... 399/359; 399/344
(58) Field of Search ..... 399/53, 61, 71, 399/101, 258, 302, 343, 344, 358, 359

(56) References Cited

U.S. PATENT DOCUMENTS 5,442,430 A * 8/1995 Ishii et al. ..... 399/344
5,565,975 A * 10/1996 Kumon et al. ..... 399/302
5,710,960 A * 1/1998 Hart et al. ..... 399/359 X
6,226,490 B1 * 5/2001 Fujita et al. ..... 399/359
6,366,754 B1 * 4/2002 Sato et al. ..... 399/359 X
6,449,451 B2 * 9/2002 Tsuruya et al. ..... 399/302 X
6,519,428 B1 * 2/2003 Ohtoshi et al. ..... 399/71

FOREIGN PATENT DOCUMENTS

| | | |
|---|---|---|
| JP | 53-74037 | 7/1978 |
| JP | 59-192159 | 12/1984 |
| JP | 8-63067 | 3/1996 |
| JP | 8-248853 | 9/1996 |
| JP | 10-293432 | 11/1998 |
| JP | 2000-242152 | 9/2000 |
| JP | 2000-267366 | 9/2000 |
| JP | 2001-5243 | 1/2001 |
| JP | 2001-092208 | * 4/2001 |

* cited by examiner

*Primary Examiner*—Sandra Brase
(74) *Attorney, Agent, or Firm*—Oblon, Spivak, McClelland, Maier & Neustadt, P.C.

(57) ABSTRACT

Toners resided after transferring toner images on a photosensitive member are collected and reused as recycled toners once returned to developing devices. A mixture ratio of the recycled toner to a specific color toner in each of the developing devices is controlled below a limiting color mixture ratio to suppress reduction in image quality due to the toner collected from an image carrier and reused as the recycled toner. The limiting color mixture ratio is defined as a color mixture ratio of a recycled toner to a color toner when a tone variation in another image reaches to a permissible limitation level.

28 Claims, 8 Drawing Sheets

COLOR MIXTURE RATIO OF YELLOW IN MAGENTA

COLOR MIXTURE RATIO OF MAGENTA IN CYAN

IMAGE FORMATION METHOD AND IMAGE FORMATION APPARATUS

FIELD OF THE INVENTION

The present invention relates to an image formation method and an image formation apparatus such as a copier, a printer and a facsimile.

BACKGROUND OF THE INVENTION

Recently, mass colored documents are handled even in an office and accordingly smaller and faster image formation apparatus such as full-color printers and full-color copiers are desired increasingly more than before. A recent widespread color laser printer is generally provided with a plurality of developing devices arranged touchable with one photosensitive member. Each of different colored toner images is formed per revolution of the photosensitive member and the images are transferred in turn from the photosensitive member to a recording material such as a recording paper and an OHP sheet to form a colored toner image. This printer is the so-called one-drum type of mainstream.

The one-drum image formation apparatus are classified into an intermediate transfer type and a direct transfer type. The former is configured to primarily transfer toner images of different colors from a photosensitive member and superimpose them on an intermediate transfer member, then secondarily transfer the toner images together onto a recording material. The latter is configured to transfer toner images of different colors from a photosensitive member sequentially onto a recording paper held on a transfer drum and the like to form a colored toner image.

The image formation apparatus of the direct transfer type has an advantage because of a simple structure, low cost and ability of high-speed image formation. The direct transfer type, however, is difficult to achieve stable transfers because resistances and water contents of the recording paper vary during sequential transfers of different color toners to the recording paper. In contrast, the image formation apparatus of the intermediate transfer type can achieve stable transfers because the transfer of the toner image to the recording paper is required only once. If the image formation apparatus of the direct transfer type employs a transfer drum which wraps a recording material thereon, it has a limitation in a thickness and type of the recording material. To the contrary, the image formation apparatus of the intermediate transfer type has an advantage because it has no limitations in thickness and types of recording materials and is possible to increase their versatility.

In the case of formation of a full-color image from four toner images superimposed, for example, either type of the one-drum image formation apparatus is required to rotate the photosensitive member at least four turns to form different color toner images. This is disadvantageous because formation of a color image requires a long time, which lowers a yield.

In order to respond to high-speed color image formation, plural (three or four in general) photosensitive members are arranged along a path which conveys a recording material. Plural developing devices are respectively mounted on the plural photosensitive members to develop latent images of different colors formed individually on the photosensitive members into toner images, which are transferred sequentially to and successively superimposed on the recording material conveyed to form a color image. Such the configuration can be found in an image formation apparatus of the so-called tandem or inline type proposed in the art. For example, Japanese Patent Application Laid-Open No. 53-74037 (U.S. Pat. No. 4,162,843) proposes an image formation apparatus, which comprises plural photosensitive members mounted thereon for sequentially multiple-transferring toner images on a recording material that is conveyed using a belt-like conveyer unit.

The image formation apparatus of the tandem or inline type is possible to form an image at a higher speed four times or more than that of the image formation apparatus of the one-drum type if the photosensitive members have the same speed on the perimeter. The image formation apparatus of the tandem or inline type is generally configured to transfer the toner image from the photosensitive member directly onto a recording material. This configuration causes several problems because of unstable transferring of the toner image onto the recording material and difficult positioning of the recording material at the time of transferring the toner image, as described above. An image formation apparatus of the so-called tandem intermediate transfer type is proposed to solve such problems, which belongs to the tandem type and employs an intermediate transfer member (see Japanese Utility Model Application Laid-Open No. 59-192159, for example).

The image formation apparatus of such the type is configured to form toner images of different colors on photosensitive members or image carriers using plural developing devices that contain different color toners therein. The toner images are transferred to and superimposed on an intermediate transfer member or a recording material. Then, different color toners not transferred and resided on the surfaces of the photosensitive members are removed and collected by a cleaning device which prepares the next image to be formed on the surfaces of the photosensitive members. The cleaning device may have a configuration for removing and collecting the non-transferred different color toners from the photosensitive members without mixing them. In this case, the different color toners removed and collected by the cleaning device from the photosensitive members can be reused as recycled toners when the collected toner is returned to the corresponding developing device that contains the same color toner.

A color image formation apparatus of the tandem type comprises plural (three or four in general) image formation units each including photosensitive members, developing devices and cleaning devices by the number corresponding to the different color toners required for full-color image formation. Each image formation unit is configured to individually form a toner image of each color. Accordingly, in this color image formation apparatus of the tandem type, non-transferred toner resided on each photosensitive member can be collected by the cleaning device corresponding to each photosensitive member without causing color mixture. Therefore, each color toner collected by each cleaning device can be returned to each developing device and easily reused as a recycled toner.

Recycling of the collected toner is particularly important in the image formation apparatus which forms color images as described above. The image formation apparatus of this type is often employed to create an image with a larger image area rate and a larger number of colors compared to a monochromic image, such as a photographic draft, and accordingly consumes relatively larger amounts of color toners. It is difficult, however, to reserve a storage space for housing sufficient amounts of color toners as the apparatus is downsized and weight reduced. Therefore, it is an important point to recycle the collected toner from the viewpoint of reducing its resource, space and running cost.

The conventional image formation apparatus has the following problem, however, if the collected toners of plural colors are employed as recycled toners.

In such the image formation apparatus that employs plural color toners to form an image, a different color toner may be mixed in the collected toner of each color that is removed and collected by the cleaning device from the photosensitive member. In this case, when the collected toner is reused as a recycled toner, influence from the color mixture may reduce the image quality.

The color mixture of the collected toner occurs in any types of image formation apparatus. In particular, the one-drum image formation apparatus is generally configured to create toner images of different colors sequentially on one photosensitive member and collect residual toners of different colors resided on the photosensitive member using one cleaning device. Therefore, the color mixture of the collected toner can not be avoided. The residual toners of different colors can be collected using plural cleaning devices corresponding to the different colors. In this configuration, similar to the image formation apparatus of the tandem type, extreme color mixture of the collected toner can be avoided. Even in such the configuration, however, the color mixture of the collected toner can not be avoided.

For example, four developing devices are employed to accommodate toners of four colors including yellow, magenta, cyan and black individually. Four toner images are formed in order of yellow, magenta, cyan and black on one or four photosensitive members used as image carriers. The color toner images formed on the photosensitive members are primarily transferred to and superimposed on an intermediate transfer member. Then, the toner images on the intermediate transfer member are secondary transferred integrally onto a recording material. Residual color toners resided on the photosensitive members after the primary transfer are collected individually on a color toner basis using four cleaning devices corresponding to the residual color toners. This case will be considered on the assumption that no toner is resided on the intermediate transfer member after the secondary transfer.

In the above case, after a toner image of the first color or yellow is transferred to the intermediate transfer member, other color toners can not be mixed in the toner resided on the photosensitive member. Therefore, if the residual toner of the first color is collected, the collected toner can be reused directly as a recycled toner without reduction in image quality.

If the toner images of the second and lower orders including magenta, cyan and black are primarily transferred sequentially to the intermediate transfer member, however, other color toners may be mixed in the toners resided on the photosensitive members.

In the image formation apparatus of such the type, when a toner image of the second color or magenta is transferred to the intermediate transfer member, the yellow toner already primarily transferred on the intermediate transfer member is inversely transferred to the surface of the photosensitive member. In this case, the toner of the first color or yellow inversely transferred may be mixed in the residual toner consisting of the toner of the second color or magenta resided on the photosensitive member. Similarly, the toners of the first color or yellow and the second color or magenta inversely transferred to the photosensitive member may be mixed in the residual toner consisting of the toner of the third color or cyan resided on the photosensitive member. The toners of the first color or yellow, the second color or magenta and the third color inversely transferred to the photosensitive member may be mixed in the residual toner consisting of the toner of the fourth color or black resided on the photosensitive member.

From the above reason, with respect to the residual toners of the second and lower orders including magenta, cyan and black, the reuse of their collected toners directly as recycled toners may possibly reduce the image quality.

Several countermeasures have been proposed for preventing such the mixture of the collected toner color. For example, Japanese Patent Application Laid-Open No. 2000-242152 discloses "Color image formation apparatus". In this apparatus, the discharge during transferring a toner image from an image carrier to an intermediate transfer member imparts a charged polarity opposite to the normal charged polarity on a part of the toner previously transferred to the intermediate transfer member. The toner with the opposite charged polarity is inversely transferred to the image carrier when a toner of the next color is transferred. From this consideration, such a collecting unit is provided that utilizes the fact that the inversely transferred toner has the opposite charged polarity. This collecting unit is effective to prevent mixture of colors from occurring on the image carrier.

The above color image formation apparatus, however, requires a unit which removes the opposite charged toners newly located in the vicinity of the photosensitive member. Such the unit has not been required in the art and causes a disadvantage because of an installation space to be reserved and cost-up due to increased components. As for the opposite charged toner, the normal charged polarity is originally stable and an amount of charge on the toner with the opposite polarity is unstable. The toners inversely transferred on the photosensitive member may often include toners charged almost "zero". Therefore, the unit which removes the opposite charged toners described above is not possible to collect the color-mixed toners completely. This method is thus not effective to reliably prevent mixture of colors from occurring in the collected toner.

Japanese Patent Application Laid-Open No. 10-293432 discloses "Image formation apparatus". This apparatus is not the tandem type but adopts a method of erasing the background potential, prior to the transferring, to prevent the opposite charging of the toner that causes the toner to be inversely transferred to the photosensitive member. The extent of the erasing is adjusted to prevent the toner image from scattering before the transferring. In practice, however, the light illumination for erasing reduces the potential sharply and makes the toner on the image section move to the periphery, resulting in a fogged image.

If the background potential before the transferring is erased insufficiently, due to the discharge during transferring the toner image from the image carrier to the intermediate transfer member, the opposite charged toner is inversely transferred to the photosensitive member. This case is similar to "Color image formation apparatus" disclosed in Japanese Patent Application Laid-Open No. 2000-242152. Therefore, the color mixture of the collected toner due to the opposite charged toner inversely transferred to the photosensitive member can not be prevented. Thus, this image formation apparatus is extremely difficult to completely prevent the color mixture of the collected toner from occurring.

Japanese Patent Application Laid-Open No. 8-63067 and 2000-267366 entitled "Image formation apparatus" describe a problem related to the toner collected by cleaning that causes aggregation of toner and reduction in charging property and propose a supply ratio of a recycled toner to be determined to correct the process condition. This image formation apparatus can not detect or predict a state of color mixture of the collected toner while paying attention to the color mixture of the collected toner as described above. When the apparatus reuses the collected toner as a recycled toner, it can not suppress reduction in image quality due to the color mixture of the collected toner.

SUMMARY OF THE INVENTION

It is an object of this invention to provide an image formation method and an image formation apparatus using the same capable of suppressing reduction in image quality due to color mixture of the toner collected from an image carrier when the collected toner is reused as a recycled toner.

The present invention has another object to provide an image formation method and an image formation apparatus using the same for reusing a color-mixed recycled toner independent of a degree of color mixture. This makes it possible to adjust an amount of the recycled toner relative to a new toner and control a variation in color reproduction in an image formed.

According to one aspect of the present invention, an image formation method comprises a latent image formation step of forming a plurality of latent images, sequentially on an image carrier, corresponding to a plurality of image colors for forming an image, a development step of supplying a plurality of specific color toners corresponding to the image colors, onto the formed latent images, from a plurality of developing devices holding the plurality of specific color toners therein, to develop the formed latent images into toner images, a image formation step of sequentially transferring the toner images to be superimposed on a recording material to form a multicolored image, the recycle step of collecting specific color toners resided after transferring the toner images on the image carrier and reusing the collected toners once returned to the developing devices as recycled toners, and a control step of controlling a mixture ratio of the recycled toner to the specific color toner in each of the developing devices below a limiting color mixture ratio, which is defined as a mixture ratio of a recycled toner to a specific color toner in a developing device when a tone variation in image is still on a permissible limitation level, which tone variation is caused from mixture of the recycled toner into the specific color toner in the developing device at the recycle step.

According to another aspect of the present invention, an image formation method comprises charging and exposing surfaces of a plurality of image carriers to form electrostatic latent images thereon, attaching specific color toners corresponding to the image carriers onto the electrostatic latent images to develop the electrostatic latent images, transferring the developed images to be superimposed on an intermediate transfer member to form toner images on the intermediate transfer member, transferring the toner images sequentially on a recording sheet, cleaning the image carriers to remove specific color toners resided thereon using cleaning devices contained in the image carriers, and forming toner images on the intermediate transfer member at the second or lower transfer order using recycled toners collected by the cleaning devices together with new toners.

According to still another aspect of the present invention, an image formation apparatus comprises an image carrier which carries a plurality of latent images formed thereon corresponding to different colors in a colored image of at least two colors, a plurality of developing devices which supplies specific color toners corresponding to image colors to develop the latent images formed on the image carrier, a transferring unit which sequentially transfers color toner images, developed on the image carrier using the specific color toners in the developing devices, to be superimposed on a recording sheet, a cleaning unit which collects toners not transferred and resided on the image carrier after transferring the toner images, a toner conveying unit which returns the toners collected by the cleaning unit to the developing devices, and a control unit which controls a mixture ratio of the recycled toner to the specific color toner in each of the developing devices using the above image formation method.

According to still another aspect of the present invention, an image formation apparatus comprises a plurality of image carriers, charging and an exposing unit which forms electrostatic latent images on the image carriers based on image signals, a developing unit which attaches specific color toners to the electrostatic latent images on the image carriers to develop the electrostatic latent images into toner images, a transferring unit which transfers the toner images sequentially onto an intermediate transfer member, a cleaning unit which removes toners attached on the intermediate transfer member after the transferring, a path unit which returns recycled toners collected by the cleaning unit to the developing unit at the time of transferring toner images on the intermediate transfer member at the second or lower transfer order, and a path unit which supplies new toners to the developing unit.

Other objects and features of this invention will become understood from the following description with reference to the accompanying drawings.

DETAILED DESCRIPTIONS

The present invention relates to an image formation method and apparatus such as a copier, a printer and a facsimile. More particularly, it relates to an image formation method and apparatus which form plural toner images on an image carrier using an image formation process such as electrostatic recording and xerography technologies, then multiple-transferring the toner images to an intermediate transfer member or a recording material. The method and apparatus employs a cleaning unit which collects non-transferred toners of different colors resided on the image carrier after transferring of the toner images to reuse the collected toners once returned to the developing devices as recycled toners.

The present invention will be explained below with respect to first through eight embodiments applied to an image formation apparatus or a color printer (hereinafter simply referred to as a "printer").

First Embodiment

Figure 1:
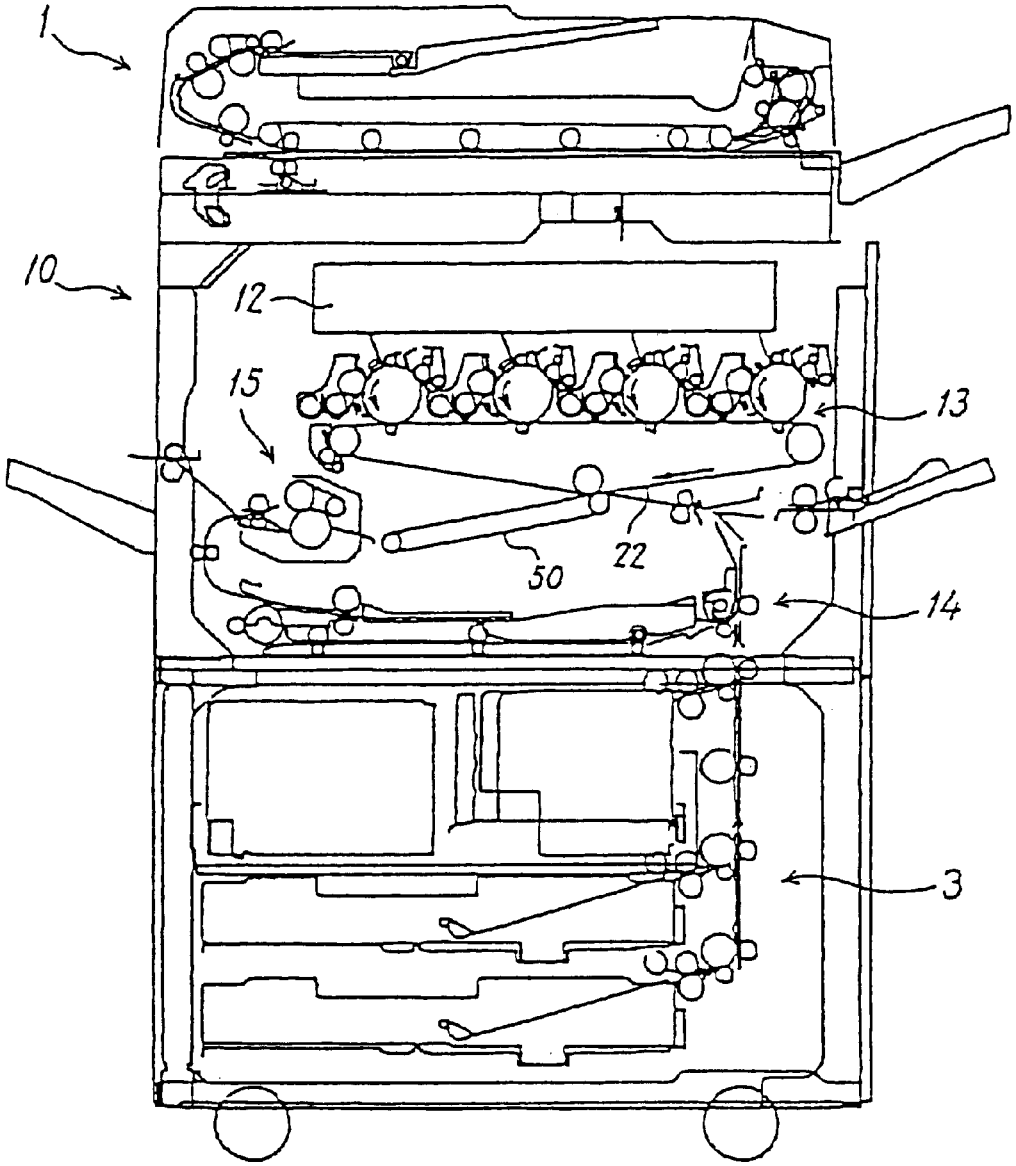
FIG. 1 shows the whole arrangement of a copier common to embodiments of the present invention.
Figure 2:
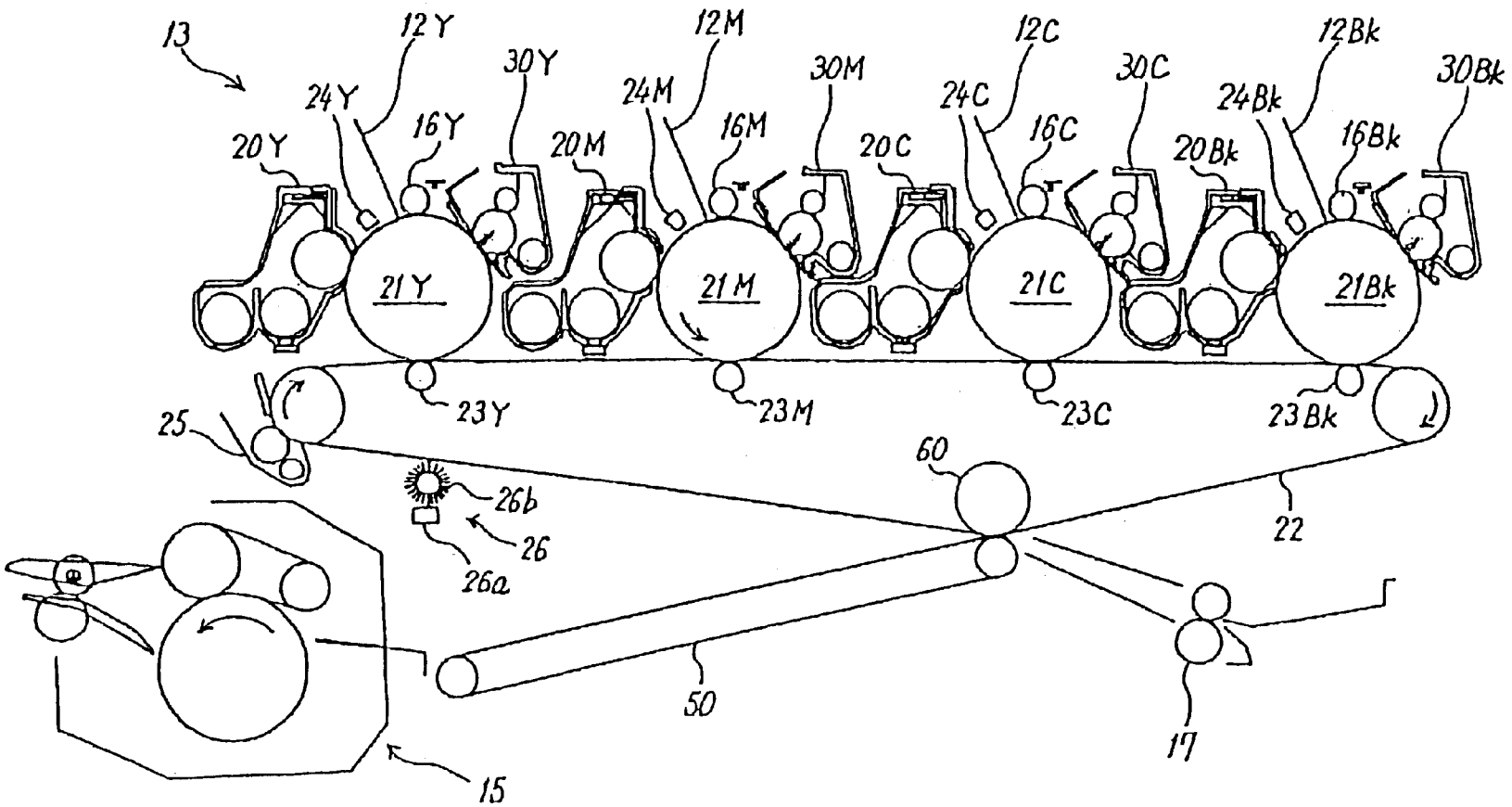
FIG. 2 shows an arrangement of an image formation section contained in the same copier.
Figure 3:
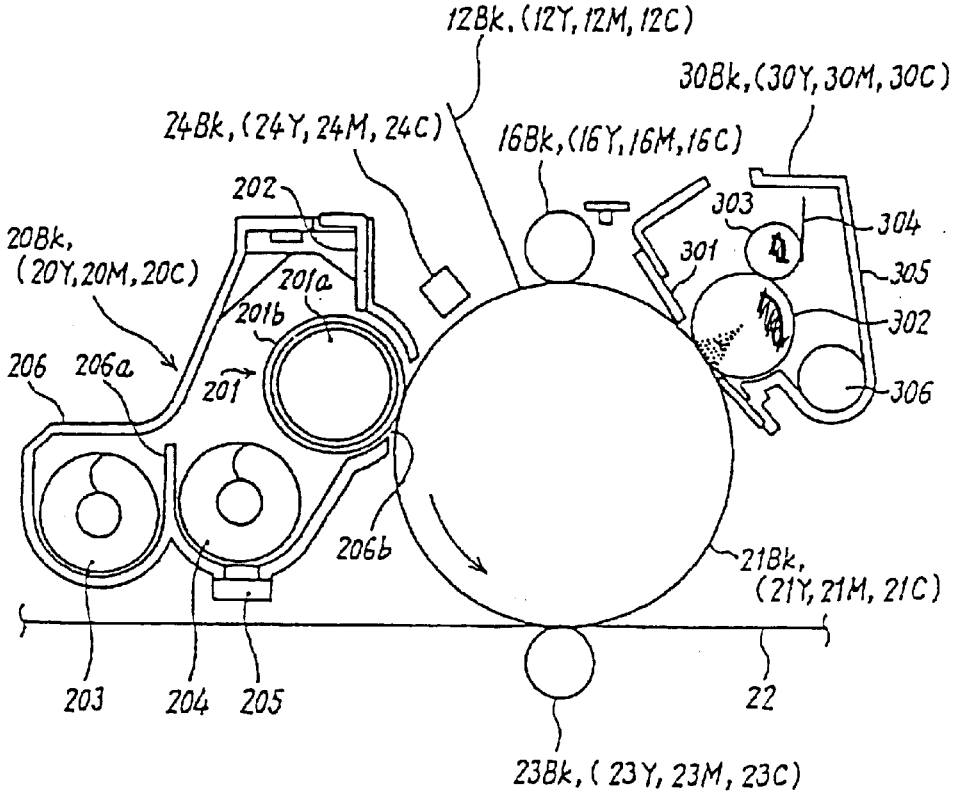
FIG. 3 shows an arrangement of image formation units provided in the same image formation section.

FIG. 1 shows the whole arrangement of a copier according to the first embodiment that includes a printer 10 mounted thereon. The printer 10 includes an image writing section 12, an image formation section 13, a paper feeder 14 and so forth for use in xerographic color image formation. FIG. 2 shows an arrangement of the image formation section 13 in the printer 10. FIG. 3 is an enlarged view of the major part shown in FIG. 2.

A brief arrangement and operation of the printer 10 is explained. In FIGS. 1 and 2, image signals, processed at an image processor 1 in the copier based on image signals, are converted into color signals of magenta (M), yellow (Y), cyan (C) and black (B) for image formation. These color signals are transmitted to the image writing section 12 in the printer 10. As shown, the image writing section 12 includes a laser scanning optical system consisting of a laser source, a deflector such as a rotary polygon mirror, a scanning focus optical system and a group of mirrors. It also includes an LED writing system consisting of a one- or two-dimensional array of multiple LEDs and a focus optical system and has four writing optical paths 12BK, 12Y, 12M, 12C corresponding to the above color signals. As shown in FIG. 2, the image writing section 12 is employed to write an image corresponding to each color signal, through each of the writing optical paths 12BK, 12Y, 12M, 12C, into each of photosensitive members 21Y, 21M, 21C, 21BK in the four image formation units of different colors located in the image formation section 13.

An OPC photosensitive material is generally employed as the photosensitive members 21Y, 21M, 21C, 21BK for the image formation sections of yellow (Y), magenta (M), cyan (C) and black (B) located in the image formation section 13. As shown in FIGS. 2 and 3, arranged around the photosensitive members 21Y, 21M, 21C, 21BK are chargers 16Y, 16M, 16C, 16BK, an exposure section of the laser light from the image writing section 12, developing devices 20Y, 20M, 20C, 20BK for different colors of black, magenta, yellow and cyan, primary transfer bias rollers 23Y, 23M, 23C, 23BK serving as a primary transfer unit, cleaners 30Y, 30M, 30C, 30BK, and erasers 24Y, 24M, 24C, 24BK which erase charges from the surfaces of the photosensitive members.

Developing devices of the two-component magnetic brush type are employed as the developing devices 20Y, 20M, 20C, 20BK.

An intermediate transfer belt 22 is suspended so as to be interposed between each of the photosensitive members 21Y, 21M, 21C, 21BK and each of the primary transfer bias rollers 23Y, 23M, 23C, 23BK. Toner images of different colors formed on the photosensitive members are sequentially transferred to and superimposed on the intermediate transfer belt 22.

A recording paper, fed from the paper feeder 14 in the printer 10 or a paper feed bank in the above copier (see FIG. 1), is carried on a transfer conveying belt 50 via a resist roller 17 shown in FIG. 2. The toner images once transferred on the intermediate transfer belt 22 are secondarily transferred (integrally transferred) to the recording paper, at a location where the intermediate transfer belt 22 contacts with the transfer conveying belt 50, using a secondary transfer bias roller 60 serving as a secondary transfer unit. This operation forms a color image on the recording paper P. The recording paper P having thus formed color image thereon is conveyed on the transfer conveying belt 50 to a fixing device 15. After the transferred image is fixed on the recording paper P at the fixing device 15, the recording paper P is rejected out of the body of this printer.

Residual toners not transferred to the recording paper at the time of the secondary transfer and resided on the intermediate transfer belt 22 are removed from the intermediate transfer belt 22 using a belt cleaner 25.

A lubricant applicator 26 is located at the upstream from the belt cleaner 25. This lubricant applicator 26 includes a solid lubricant 26*a* and a conductive brush 26*b* which frictionally slides on the intermediate transfer belt 22 to apply the solid lubricant 26*a* thereto. The conductive brush 26*b* always contacts with the intermediate transfer belt 22 to apply the solid lubricant 26*a* to the intermediate transfer belt 22. The solid lubricant 26*a* is operative to provide the intermediate transfer belt 22 with increased cleaning ability and improved durability while preventing occurrence of filming.

Prior to writing of images, surfaces of the photosensitive members 21Y, 21M, 21C, 21BK are charged to about −700 V from the chargers 16Y, 16M, 16C, 16BK located at the upstream of the writing optical paths 12BK, 12Y, 12M, 12C. In the printer 10 according to the first embodiment, conductive rubber rollers are employed as the chargers 16Y, 16M, 16C, 16BK. The rubber rollers as the chargers 16Y, 16M, 16C, 16BK are spaced from the photosensitive members 21Y, 21M, 21C, 21BK by a distance of about 50 $\mu$m each to charge them under a non-contact condition. An AC voltage of about 1 kHz is applied on the rubber rollers. The AC voltage has a peak-to-peak voltage of 2 kV and the central value set to about −800 V. This voltage is effective to charge the surfaces of the photosensitive members 21Y, 21M, 21C, 21BK uniformly to about −700 V.

The above described non-contact charging type is not a limited example of a unit which charges the surfaces of the photosensitive members 21Y, 21M, 21C, 21BK. Other charging unit may include types of, contact charging using conductive rubber rollers located in contact with the photosensitive members 21Y, 21M, 21C, 21BK to charge them, AC+DC charging, DC bias roller charging for charging the photosensitive members with only a DC bias of about −1400 V and no AC bias applied, corona charging employing a corotron or scorotron previously well used, and brush charging.

After the surfaces of the photosensitive members 21Y, 21M, 21C, 21BK are charged as described above, images are written from the writing image section 12 into the surfaces of the photosensitive members 21Y, 21M, 21C, 21BK. This operation is effective to form electrostatic latent images corresponding to color images of black, magenta, yellow and cyan on the surfaces of the photosensitive members 21Y, 21M, 21C, 21BK. These electrostatic latent images are developed in the developing devices 20Y, 20M, 20C, 20BK for different colors of black, magenta, yellow and cyan.

As shown in FIG. 3, the developing devices 20Y, 20M, 20C, 20BK each comprise a developing roller 201, a doctor blade 202, two screws 203, 204, a toner density sensor 205 and a developing case 206. The developing roller 201 has a certain positional relation with the screws 203, 204 such that the screws 203, 204 are located at lower positions in a slanting direction relative to the developing roller 201. The two screws 203, 204 are located in parallel with the horizontal direction. A partition 206*a* is located in the developing case 206 to isolate the two screws 203 and 204. This partition 206*a* divides the developing case 206 into two rooms. The rear and front parts of the partition 206 a are notched so that the two screws 203 and 204 can circulate developers in the rooms of the developing case 206.

An opening 206*b* is formed in a portion of the developing case 206 facing to the photosensitive member. A part of the developing roller 201 is exposed through the opening 206*b*. As shown in FIG. 3, the developing roller 201, the two screws 203, 204 and the doctor blade 201 are arranged in the developing case 206 so as to be able to reserve a slightly larger space above the screw 204.

The developing cases 206 for the developing devices 20Y, 20M, 20C, 20BK accommodate different color developers of black, magenta, yellow and cyan for developing the electrostatic latent images corresponding to the above color images. The developer used in this example comprises a two-component developing agent that contains non-magnetic toner dispersed and mixed in a magnetic carrier.

The developers in the developing devices 20Y, 20M, 20C, 20BK are agitated and carried using the oppositely rotating two screws 203, 204 so that they can always circulate in the rooms of the developing cases 206 through the notched rear and front parts of the partition 206*a*. The developer is fed toward the developing roller 201 by the screw 205 which circulates, agitates and carries. The developing roller 201 includes a magnetic roller 201 a serving as a magnetic field generator unit and a non-magnetic developing sleeve 201*b* rotatably mounted over the magnetic roller 201*a* which covers the perimeter.

By means of the magnetic force from the magnetic roller 201*a* and the rotations of the developing sleeve 201*b*, the developer fed to the developing roller 201 as described above can be lifted up to the surface of the developing sleeve 201*b* and held in the form of a magnetic brush. The developer held in the form of a magnetic brush on the surface of the developing sleeve 201*b* rotates and moves toward the opening 206*b* in the developing case 206 as the developing sleeve 201*b* rotates. The developer is trimmed by the doctor blade 202 at the front of the opening 206*b* and weighted to have a suitable amount, then sent to a developing region between the surface of the developing roller 201 exposed through the opening 206*b* and the surface of the photosensitive member.

The developer trimmed by the doctor blade 202 and blocked to advance toward the above developing region drops on the screw 205 by gravity along the perimeter of the developer held in the form of a magnetic brush on the surface of the developing sleeve 201*b*. Then, it is returned to the circulation path in the developing case 206. The developer returned to the circulation path is agitated and carried again by the two screws 203, 204, then fed to the developing roller 201 again by the screw 205.

On the other hand, the developer that is sent to the above developing region is employed to transfer the toner to an electrostatic latent image formed on the photosensitive member to develop the electrostatic latent image and form a toner image on the photosensitive member. A developing bias is applied to the developing sleeve 201*b*. The developing bias consists of an AC voltage of 2.25 kHz having a peak-to-peak voltage of about 1 kV and the central value of −500 V. This developing bias causes a potential difference between the developing sleeve and an exposed region (with a charged potential of about −150 V) on the photosensitive member. This potential difference is effective to transfer the toner contained in the developer held on the developing sleeve 201*b* to the electrostatic latent image formed on the photosensitive member.

An excessive part of the developer consisting of the toner and carrier not consumed during the development of the electrostatic latent image and held on the developing sleeve 201*b* is returned into the developing case 206. Then, it separates from the surface of the developing sleeve 201*b* at a location where the magnetic force from the magnetic roller 201*a* on the surface of the developing sleeve 201*b* can not work, and drops by gravity onto the screw 205. Thereafter, the excessive developer is collected in the circulation path of the developing case 206, agitated and carried again by the two screws 203, 204, then fed to the developing roller 201 again by the screw 205.

As described above, the developer is agitated and carried by the two screws 203, 204 and repeatedly fed to and collected from the developing sleeve 201*b* while circulating in the developing case 206. As the toner in the developer is consumed progressively along with repeated executions of the step of developing the electrostatic latent image on the photosensitive member, the density of the toner in the developer housed in the developing case 206 is gradually lowered. In each of the developing devices 20Y, 20M, 20C, 20BK, the density of the toner in the developer housed in the developing case 206 is detected by the toner density sensor 205. On the basis of the result detected by the toner density sensor 205, so as to keep the toner density in the developer in the developing case 206 always be constant, a toner supplement device, not depicted, is employed. This device can feed a new supplementary toner into the developing case 206 at a suitable time.

Through the use of the primary transfer bias rollers 23Y, 23M, 23C, 23BK arranged corresponding to the photosensitive members, the toner images of different colors thus formed on the surfaces of the photosensitive members 21Y, 21M, 21C, 21BK are primarily transferred to and superimposed on the intermediate transfer belt 22 that rotationally contacts with the surface of each photosensitive member. The primary transfer bias rollers 23Y, 23M, 23C, 23BK are opposed to the photosensitive members, sandwiching the intermediate transfer belt 22 therebetween, to generate a transfer electric field on a primary transfer region between each photosensitive member and the intermediate transfer belt 22. The transfer electric field is operative to electrostatically transfer a toner image on the photosensitive member to the intermediate transfer belt 22. In the first embodiment, the transfer electric field is generated from a primary transfer bias roller composed of a conductive foamed EPDM rubber (rubber hardness, JIS-A30-degree, volume resistivity, $10^8$ Ωcm), to which a voltage of about 1.5 kV is applied.

The intermediate transfer belt 22 can be composed of various materials. Preferable examples include, a polyimide belt with excellent durability and high Young's modulus, a Pvdf belt excellent in surface smoothness, and a multi-layered belt having a structure consisting of a polyurethane resin layer, a polyurethane rubber layer formed thereon, a coating layer formed thereon that contains a fluorine component, and an elastic layer formed on the surface. In particular, a multi-layered belt including an elastic coating layer formed on a polyurethane rubber layer has an elastic surface that can tightly contact with a surface of a photosensitive member or a recording material and provide excellent primary and secondary transfer properties. Preferably, the intermediate transfer belt 22 has an excellent transfer property with characteristic values that include a volume resistivity of about $10^{10}$-$10^{12}$ cm and a surface resistivity of $10^{12}$ Ω/□ or more at a portion that receives toner attached thereon.

As described above, the color toner images formed on the photosensitive members 21Y, 21M, 21C, 21BK are primarily transferred to and superimposed on the intermediate transfer belt 22 to form a full-color image composed of four color toners on the intermediate transfer belt. The full-color image formed on the intermediate transfer belt 22 is secondarily transferred (integrally transferred) to the recording paper P by the secondary transfer bias roller 60 when the recording paper P is fed by the resist roller 17 and carried on the transfer conveying belt 50. The recording paper P having the full-color image secondarily transferred thereto is conveyed on the transfer conveying belt 50 to the fixing device 15 and, after the secondarily transferred image is fixed at the fixing device 15, it is rejected out of the body of the printer.

The residual toners stayed after the secondary transfer on the intermediate transfer belt 22 are removed from the intermediate transfer belt 22 by the belt cleaner 25. Thereafter, the image formation units of different colors in the image formation section 13 are employed to form the next images.

The cleaners 30Y, 30M, 30C, 30BK which remove the toners resided after the next transfer on the photosensitive members will be explained. The cleaners in the first embodiment each employ a well known cleaner that includes a cleaning blade 301 composed of elastic polyurethane rubber and a conductive fur brush 302 together as shown in FIG. 3. A metallic, electric field roller 303 is arranged in contact with the fur brush 302. A scraper 304 is arranged in contact with the electric field roller 303.

In FIG. 3, the toner resided on the photosensitive member is scraped off from the photosensitive member by the fur brush 302 that rotates in the counter-direction opposite to the rotation of the photosensitive member. The toner attached on the fur brush 302 is attached to and removed by the electric field roller 303 that rotates in the counter-direction relative to the fur brush 302. The toner attached on the electric field roller 303 is scraped off by the scraper 304 and collected in a cleaning case 305. A cleaning bias is applied to the electric field roller 303 to generate an electrostatic force, which is employed to move the residual toner on the photosensitive member from the fur brush 302 to the electric field roller 303. Finally, the residual toner is scraped off from the electric field roller 303 by the scraper 304.

The toner thus collected in the cleaning case 305 is sent by a collecting screw 306 to a waste toner bottle, not depicted, or the developing device in the image formation unit that contains this cleaner mounted thereon. The printer in the first embodiment reuses the toner collected by the collecting screw 306 from the cleaning case 305 and returned to the corresponding developing device.

In the cleaner of an image formation unit, the collecting screw 306 is located above another image formation unit adjoined at the downstream of that cleaner over a portion of the developing case 206 above the screw 203 in the developing device. This arrangement is possible to locate the image formation units closer to each other and downsize the body of the printer.

In addition to a full-color mode for forming a full-color image using all the above four color toners, this printer has various modes of image formation, which includes, a monochromic mode for forming a monochromic image using a single toner of yellow or cyan, an image formation mode such as a two-color mode using two color toners which form a two-colored image, for example, a green image of yellow mixed with cyan, a red image of yellow mixed with magenta and an image of cyan or yellow with black texts indicated thereon, and an image formation mode such as a three-color mode.

The toner images formed on the photosensitive members 21Y, 21M, 21C, 21BK are transferred to the intermediate transfer member 22 as described above. In this case, parts of the toners are not transferred and stayed on the photosensitive members 21Y, 21M, 21C, 21BK. The residual toners are collected individually by the cleaners 30Y, 30M, 30C, 30BK provided for the photosensitive members 21Y, 21M, 21C, 21BK.

This printer 10 is equipped with the four photosensitive members 21Y, 21M, 21C, 21BK corresponding to the toners of four colors for use in image formation. These color toners resided on the photosensitive members 21Y, 21M, 21C, 21BK can be cleaned and collected individually by the cleaners 30Y, 30M, 30C, 30BK. Accordingly, this printer 10 can easily reuse each of the color toners as each of recycled toners when the color toners are collected by the cleaners 30Y, 30M, 30C, 30BK and returned to the corresponding developing devices 20Y, 20M, 20C, 20BK.

In such the printer 10 of the tandem type, the image formation units which form toner images of different colors are separated from each other. Therefore, mixture of the toner color can not be caused theoretically but it occurs practically. Such the mixture of the toner color occurs during transfers from the photosensitive members 21Y, 21M, 21C, 21BK to the intermediate transfer belt 22.

In the printer 10, when the toner image of the second color is transferred to the intermediate transfer belt 22, the toner image of the first color has been already transferred on the intermediate transfer belt 22. Therefore, a part of the toner in the toner image of the first color may be inversely transferred from the intermediate transfer belt 22 to the photosensitive member when the toner image of the second color is transferred. The toner inversely transferred to the photosensitive member is collected together with the residual toner of the second color by the cleaner corresponding to the photosensitive member which forms the toner image of the second color. Thus, the toner of the first color is mixed in the toner collected by the cleaner for the second color.

As the above color-mixed toner causes reduction in image quality, it has been mixed all in the developing device for black toner that has a high limiting color mixture ratio for reuse or disposed as waste toner in the art. If the color-mixed toner is mixed all in the developing device and employed, it is difficult to balance a consumption amount of the toner contained in the developing device with a supply amount of the color-mixed toner to the developing device. Depending on a type of an image to be formed, the printer which forms color images as described above often processes a draft of photographic image and the like with less black and white parts. Therefore, if the color-mixed toner is returned to the developing device and reused as a recycled toner, the amount of the recycled toner supplied to the developing device may possibly exceed the amount of the toner consumed. If the color-mixed toner collected is directly mixed all in the developing device of each color, a color phase of the toner in the developing device greatly differs from a state of no color mixture. This is a problem.

The Inventors et al. have studied about a color mixture ratio of the color-mixed toner concerned to a color phase of a final image formed from the above color-mixed toner. It was found from the study that if a color mixture ratio of a different color toner to a specific color toner contained in a developing device is lower than a certain color mixture ratio, a variation in the color phase of the final image is on a permissible level. A limiting color mixture ratio is herein defined as a value of the color mixture ratio of a different color toner to a specific color toner when the variation in the color phase of the final image reaches a permissible limiting level. The color mixture ratio of the toner in each developing device is set below the limiting color mixture ratio to form an image. As a result, it was found that if the color mixture ratio of the toner in each developing device is below the limiting color mixture ratio, an image could be obtained that has a permissible variation in the color phase due to the color-mixed toner.

Examples of the above first embodiment are explained next.

EXAMPLE 1

In the printer 10 shown in FIG. 1 the developing device 20M for magenta toner was employed to perform the following experiment. An image was formed using a color-mixed toner composed of yellow toner mixed at a known color mixture ratio in a certain amount of a two-component developer consisting of magenta toner and carrier contained in the developing device 20M. An image is also formed from a toner composed of 100% magenta toner and compared with the image formed from the color-mixed toner to measure a difference between their color phases. Mixture ratios of magenta toner to yellow toner used in the developer in the experiment and evaluation results of color phases of the formed images are shown in Table 1. In this experiment, a photograph of a fruit is employed as a draft image, which is printed out by the developer, and a color phase of the printed image was visually evaluated based on a color variation of the fruit.

TABLE 1

| Agent No. | Carrier weight (g) | Toner magenta weight (g) | Toner yellow weight (g) | a* in La*b* Color specification system | b* in La*b* Color specification system | Visual evaluation |
|---|---|---|---|---|---|---|
| Comparison | 644 | 56 | 0 | 73.6 | 11.5 | ○ |
| 1 | 644 | 55.4 | 0.6 | 73.1 | 12 | ○ |
| 2 | 644 | 54.9 | 1.1 | 71.1 | 13.3 | ○ |
| 3 | 644 | 53.2 | 2.8 | 71.9 | 15.5 | ○ |
| 4 | 644 | 52.6 | 3.4 | 71 | 17 | ○ |
| 5 | 644 | 52.1 | 3.9 | 71.1 | 19.8 | X |
| 6 | 644 | 50.4 | 5.6 | 70.4 | 23.8 | X |

As a result of the above experiment, it was found that if images are formed using developers of Agent No. 1, 2, 3, 4 in Table 1, final images output have color phases above a permissible level. A visual evaluation for the image that has a color phase above the permissible level is indicated with the mark "O". It was also found that if images are formed using developers of Agent No. 5, 6 in Table 1, final image outputs have color phases below the permissible level. A visual evaluation for the image that has a color phase below the permissible level is indicated with the mark "x". Color mixture ratios of yellow toner to magenta toner of Agent No. 1, 2, 3, 4 ranged within 1–6%. Finally, the limiting color mixture ratio of yellow toner in magenta toner was determined 6%.

Figure 4:
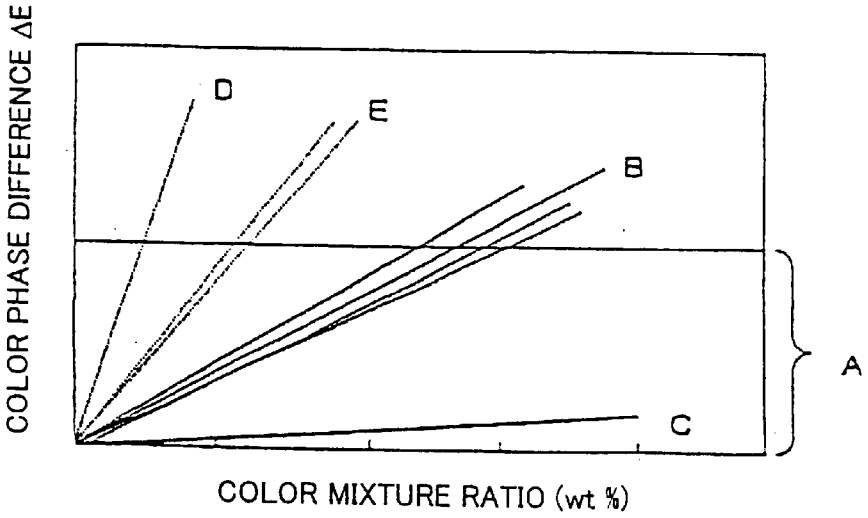
FIG. 4 is a graph which shows color phase differences when four color toners of yellow, magenta, cyan and black are mixed together.

The Inventors also performed similar experiments to measure differences in color phases of images at different color mixture ratios using developers with combinations of color toners obtained by mixing different color toners at a predetermined color mixture ratio in other specific color toners. FIG. 4 shows a graph, which indicates a color mixture ratio of the toner along the horizontal axis and a color phase difference measured in the above experiment along the vertical axis. This graph shows color phase differences when four colors of yellow, magenta, cyan and black are mixed together. When a tolerance of a color difference is represented by A, an image may be formed under a color mixture condition within a range of A. Therefore, a limiting color mixture ratio of each color can be represented by an X-coordinate at a cross point between A and each line.

In the graph shown in FIG. 4, the group C concerns the case of each color toner mixed in black toner, the group D the case of black toner mixed in yellow toner, the group E the case of black toner mixed in cyan and magenta toners, and the group B the case of other color toners combined.

Limiting color mixture ratios of different colors can be obtained from the above graph. With respect to a total of limiting color mixture ratios when other three colors are mixed in each toner, yellow toner having the smallest total is employed for the first color and black toner having the largest total for the fourth color to output an image. Magenta toner is employed for the second color and cyan toner the third color. The limiting color mixture ratio of yellow toner to magenta toner is determined 6%, the limiting color mixture ratio of magenta toner to cyan toner is determined 7%, and the limiting color mixture ratio of cyan toner to black toner is determined 40%. As a result, when a full-color image is printed, a nice image can be obtained.

In a different color order of color toners in image formation, a nice image can be obtained similarly. In this case, however, the recycled toner in the developing device for yellow toner was less consumed. This is because the limiting color mixture ratio of yellow toner is the lowest and, if the image formation order of yellow toner is lowered, an amount of the recycled toner returnable to the developing device for yellow toner is extremely reduced.

Preferably, when the toner collected by cleaning is reused as a recycled toner, an amount of the recycled toner supplied to the developing device is controlled to keep a color mixture ratio of toner in each developing device below the limiting color mixture ratio.

In the above printer, the amount of the toner in the developing device gradually decreases as the toner is consumed by attaching on a latent image formed on the photosensitive member. In such the system, a new toner is sequentially supplemented to each developing device by an amount corresponding to the toner decreased along with consumption to achieve continuous attachment of toner on the latent image formed on the photosensitive member.

When the collected toner is reused as a recycled toner, the recycled toner and the new toner are supplemented to each developing device. In this printer, a total amount of the recycled toner and new toner supplied to each developing device is adjusted identical to the amount of toner consumed in each developing device to achieve a constant total amount of toner in each developing device. A different color toner mixed in each developing device is contained only in the recycled toner and not in the new toner. Therefore, when the supply amount of the recycled toner is controlled suitably, a color mixture ratio of another toner to the toner in each developing device can be controlled.

As shown in the graph of FIG. 4, the above experiment clearly demonstrates a variation amount of a color phase of the final image related to a color mixture ratio of toner housed in each developing device, in accordance with a combination of colors of a specific color toner housed in each developing device and a toner mixed in the specific color toner. This printer is intended to determine the limiting color mixture ratio from a combination of colors of a toner housed in each developing device and a toner having an earlier image formation order and considered to be mixed in that toner.

The combination of colors of different color toners imparts a different influence on the final image when the toner in each developing device is mixed with other color toners. The intensity of the influence can be derived from quantification of a color difference when the color mixture ratio of another color toner to the toner in each developing device is altered. The limiting color mixture ratio for each developing device can be set from a color phase difference at the time of mixing a color of the toner housed in each developing device to a color of the toner housed in another developing device located on a immediately preceding position at the upstream in the moving direction from the intermediate transfer belt. This setting is effective to suppress an amount of phase difference variation in an image formed from the color-mixed toner in each developing device or an extent of reduction in quality of the image within a range below the permissible limiting level.

As described above, when the collected toner is used as the recycled toner, unless a ratio of the color-mixed toner in each developing device is below the permissible limiting level, a nice image can not be obtained. Then, attention is focused on consideration of image formation orders with color toners in the system and the limiting color mixture ratio. The color mixture ratios of the recycled toners for the first through fourth colors are represented by Pa, Pb, Pc, Pd and the limiting color mixture ratios of the developing devices by Ra, Rb, Rc, Rd. Assuming that the whole amount of each color toner is represented by T(g), a total amount of color-mixed toners in the recycled toner supplied to each developing device should be supplemented not to exceed T×R.

If every developing device has the same color mixture ratios of the recycled toners of all colors, the recycled toner to be reused is limited in a small amount in the developing device that houses the toner of a color with a smaller limiting color mixture ratio. Assuming that no toner is resided on the intermediate transfer belt 22, no color mixture due to the inversely transferred toner occurs in the developing device that houses the toner of the first color. Thus, Pa is equal to zero and, with respect to the first color, the whole amount of the recycled toner can be recycled. Therefore, when the above printer is employed to form a four-colored image, the developing device that houses a toner of a color with the smallest limiting color mixture ratio to other three colors is arranged as the developing device which forms a toner image of the first color. This arrangement can be employed to maximize amounts of the recycled toners usable in the developing devices over the whole system.

In this printer, the limiting color mixture ratio of yellow toner to magenta toner is set 6%. Similarly, the limiting color mixture ratio of magenta toner to cyan toner is set 7%. These settings can create a nice image as obvious from the experiment in Example 1.

A supply amount of the recycled toner of each color in this printer is determined based on a value indicating an image area of a toner image on an immediately preceding position at the upstream and a limiting color mixture ratio of the recycled toner derived from the value indicating the image area of that toner image. As described above, to the developing device which houses a toner of each color, toner is newly supplied by an amount corresponding to the amount consumed. The toner supplied to each developing device consists of a new toner and the recycled toner collected by cleaning. Therefore, when division of supply amounts of both toners is determined, the color mixture ratio of the toner of the upstream color in the recycled toner returned to each developing device is assumed from information on the image to be formed. This is effective to suppress color mixture ratios of other color toners to the toner in each developing device below the limiting color mixture ratio.

EXAMPLE 2

Figure 5:
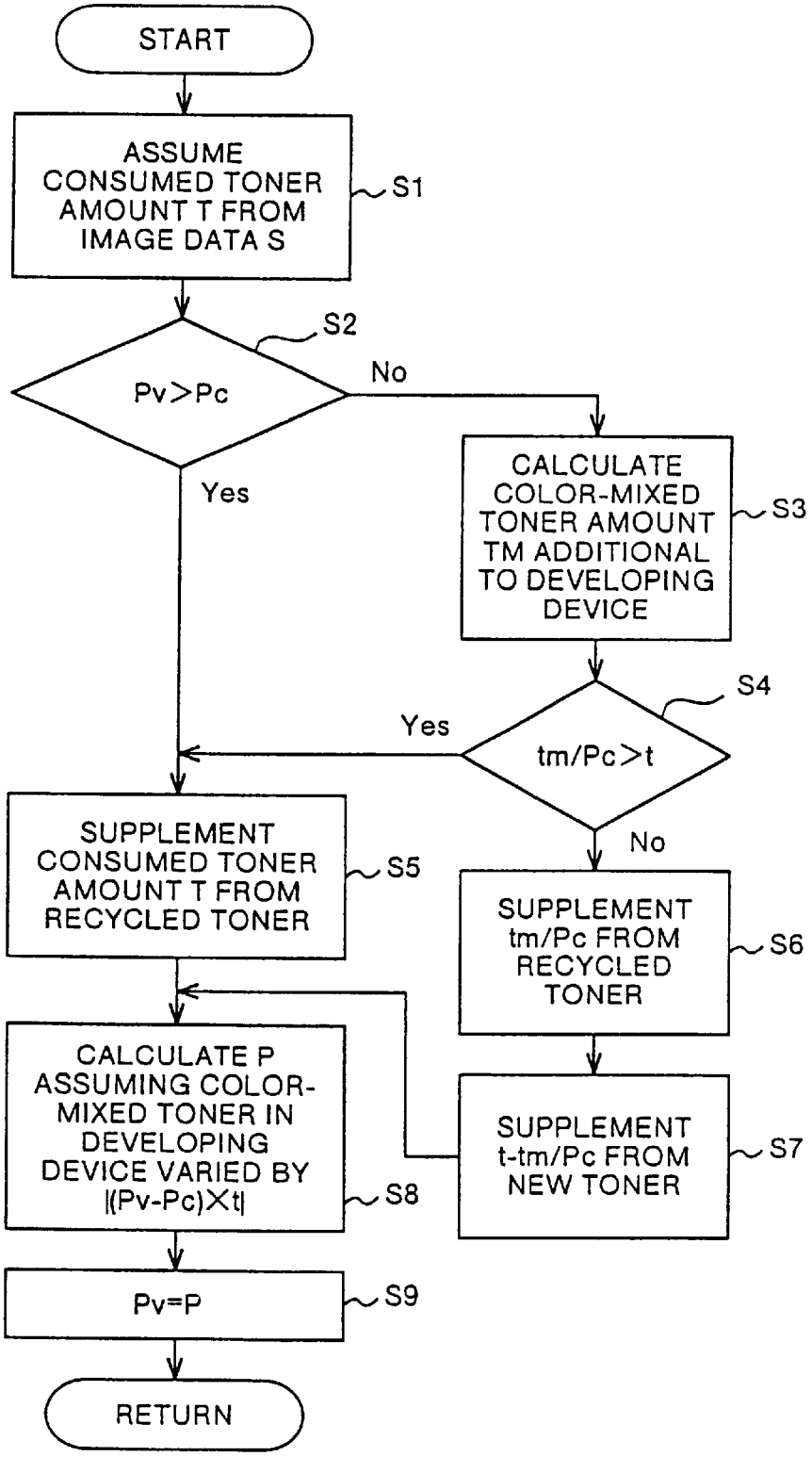
FIG. 5 is a flowchart which shows a process of supplementing a recycled toner and a new toner in the above printer.

Using the copier shown in FIG. 1 and supplementing the recycled toner and new toner to each developing device which forms a toner image of the second or lower order color in accordance with a flowchart shown in FIG. 5, an image was formed. The flowchart shown in FIG. 5 shows a process applicable to all developing devices. A process in each developing device is identical. Then, paying attention to a developing device for the second color, its process only is explained. A full-color image output from this copier is formed from toners of four colors in combination.

As shown in the step S1 of FIG. 5, a consumed amount, t, of the second color toner is assumed from color image data of the second color. Next, with respect to a relation between a color mixture ratio, Pv, in a developing device and a color mixture ratio, Pc, in a recycled toner, it is determined whether Pv>Pc or not (step S2).

If Pv>Pc, that is, the color mixture ratio Pc in the recycled toner is smaller than the color mixture ratio Pv in the developing device, the recycled toner is supplied to the developing device by the same amount as the amount, t, of the toner consumed in the developing device. In contrast, if the color mixture ratio Pc in the recycled toner is larger than the color mixture ratio Pv in the developing device, an amount, tm, of a color-mixed toner additional to the developing device is calculated (step S3). This additional amount is effective to suppress the colormixture ratio of the toner in the developing device, after the recycled toner is supplied, within a range that does not exceed the limiting color mixture ratio.

The color-mixed toner amount tm can be calculated from the whole toner amount in the developing device×(the limiting color mixture ratio−the color mixture ratio in the developing device)+the consumed toner amount t×Pv. An amount of the toner inversely transferred to the photosensitive member of the second color at the transfer section for the toner image of the second color is given by Sa×R×G. where G denotes an inverse transfer rate of the first color toner, Sa an image area of the first color, Sb an image area of the second color, and R a transfer rate. The toner of this amount is collected at the cleaner for the photosensitive member of the second color as a color-mixed toner.

In the toner image of the second color, an amount of the toner not transferred to the intermediate transfer belt and collected at the cleaner can be given from Sb×(1−R). A color mixture ratio of the recycled toner in this case is represented by Sa×R×G/((Sb×(1−R))+Sa×R×G). After time-varying n-times image formation, a value is created that consists of Sa×R×G added n-times. This value can be employed to assume a colormixture ratio after the n-times image formation. Under this assumption, the calculation in the flowchart shown in FIG. 5 was executed. At the step S4 in FIG. 5, it is determined whether tm/Pc>t. If yes, then supplement all the consumption toner amount t from the recycled toner as shown in the step S5. If no, then supplement tm/Pc from the recycled toner as shown in the step S6 and the reminder from the new toner as shown in the step S7.

After the process of such the toner supplement, an amount of variation in the color-mixed toner in the developing device is estimated as shown in the step S8, and a color mixture ratio Pv in the developing device is updated as shown in the step S9. Using such the process to produce 100 images, a color phase difference was measured every 10 images. As a result, color phase differences in all images have values within tolerance (in this experiment a limiting color mixture ratio is set on the assumption that a color phase difference within tolerance is equal to 5) and nice images are obtained.

The above process may be performed every image output, every certain number of image outputs, or every time the need is detected by the sensor. In this case, the image area may be summed and used for performing the same process.

In this example, the present invention is applied to the printer that employs the intermediate transfer belt 22. Alternatively, the present invention may be applied to an image formation apparatus of an intermediate transfer drum type in accordance with the layout of the apparatus body, accuracy required and size. The present invention may also be applied to an image formation apparatus of a direct transfer type that employs a belt or drum which conveys a recording paper, which is subjected to the direct transfer from each photosensitive member.

Second Embodiment

A second embodiment of the present invention will be explained below based on the drawings. The Inventors have studied a contribution of a color mixture ratio of toner to a color phase of a final image. As a result, it was found that the balanced use of color-mixed recycled toner and new toner allows a color phase variation to be contained within tolerance and the toner can be reused. As an apparatus feature for that purpose, it was found effective to provide an apparatus with a path which returns a color-mixed recycled toner to each developing device and a path which supplies a new toner to each developing device. The second embodiment is configured on the basis of this finding.

The whole arrangement of the second embodiment has the same arrangement as the apparatus described in the first embodiment and shown in FIGS. 1 and 2. Therefore, the whole arrangement is partly omitted to depict and describe. The arrangement of the second embodiment is similar to the arrangement of the first embodiment shown in FIG. 2 and provided with photosensitive members 21Y, 21M, 21C, 21BK in this turn from the left in the figure. Every photosensitive member is equipped with an image formation section around it. Therefore, in the second embodiment, only the photosensitive member 21Y is explained.

Figure 6:
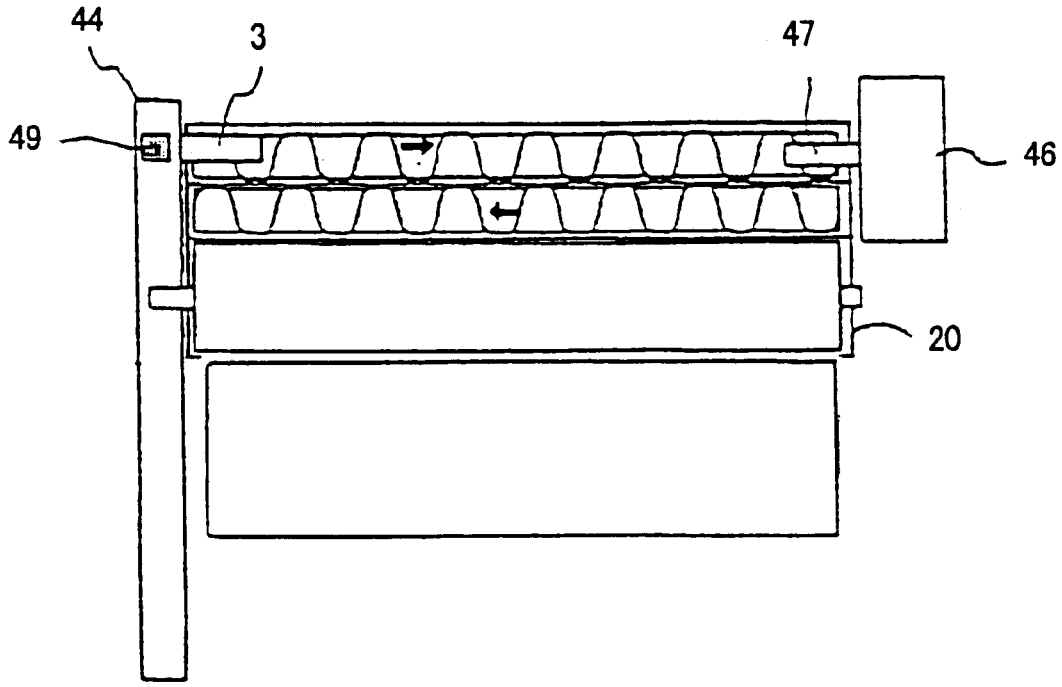
FIG. 6 shows a path which supplements a toner of the present invention.

FIG. 6 shows toner supplement paths in the second embodiment. FIG. 6 shows a collection path 44 which sends toner to a developing device 20 from a cleaner, not depicted, and a supplement path 47 which sends new toner to the developing device 20. This figure shows the collection path 44 from a cleaner 30 to the developing device 20 located at the rear of the apparatus body, a toner bottle 46 located at the front of the apparatus, and the supplement path 47 provided for sending new toner to the developing device 20. Excessive color mixture can be prevented by suitably controlling amounts of toners sent through both toner supply paths to the developing device 20. A degree of color mixture can be determined from a relation between a color mixture ratio and a color difference. A target color difference is employed to determine the degree of color mixture.

In the second embodiment, a color mixture ratio is controlled to a target of 10% or below. A ratio between amounts of recycled toner and new toner supplied to the developing device is set 1,10. Drafts of landscape, portrait and catalogue are printed out. Devices are arranged in color order of yellow, magenta, cyan and black. The recycling was performed to magenta. Accordingly, color mixture of yellow in magenta was evaluated. 1000 copies were printed per draft and a color difference was measured every 100 copies, resulting in color differences all within the target.

According to the above-described arrangement, if a constant ratio can be achieved between recycled toner and new toner supplied to the developing unit, the use of the recycled toner and new toner is effective to create a nice image even in a simple arrangement. To configure the color mixture of different color toners at a certain ratio and prevent a color-mixed toner in a developing unit from having an excessive density, the setting may be performed on the assumption that the recycled toner has an extremely high color mixture ratio. If the device is set, avoiding being excessive, even though the recycled toner has a color mixture ratio of 100%, there is no possibility to be excessive. The recycled toner, though its consumption amount is small, can be consumed at a constant ratio.

An additional arrangement comprises, a color mixture ratio detection unit which detects a color mixture ratio of a toner in a developing unit, a recycled toner supply amount determination section which determines a supply amount of the recycled toner based on a signal from the color mixture ratio detection unit, and a supplier which varies the supply amount of the recycled toner in accordance with determination by the toner supply amount determination section. This additional arrangement is effective to adjust the supply of the recycled toner based on its color mixture ratio and prevent excessive color mixture.

Figure 9:
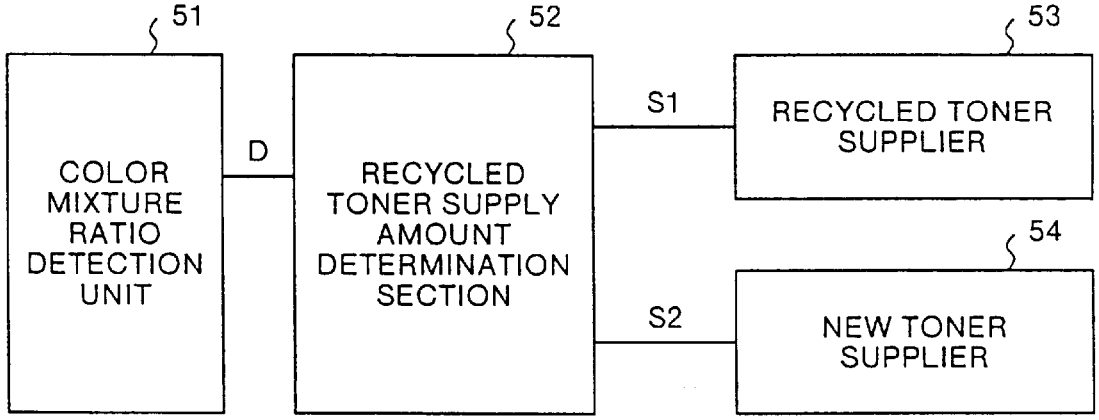
FIG. 9 is a block diagram which shows an arrangement of a fourth embodiment of the present invention.

The same process as that shown in a block diagram of FIG. 9 is performed. The color mixture ratio detected at the color mixture ratio detection unit in the block diagram is a color mixture ratio in the developing unit in the present invention. If the color mixture ratio detection unit 51 comprises a device which measures a reflective density on a developing sleeve contained in the developing unit, it can perform an accurate measurement because a constant amount of carrier+toner can be conveyed on the developing sleeve.

Third Embodiment

An additional arrangement in the third embodiment comprises a unit which mixes new toner and color-mixed recycled toner prior to supplying them to a developing device. This additional arrangement is effective to distribute the color-mixed toner uniformly and prevent remarkable color variations from occurring due to uneven color mixture.

Figure 7:
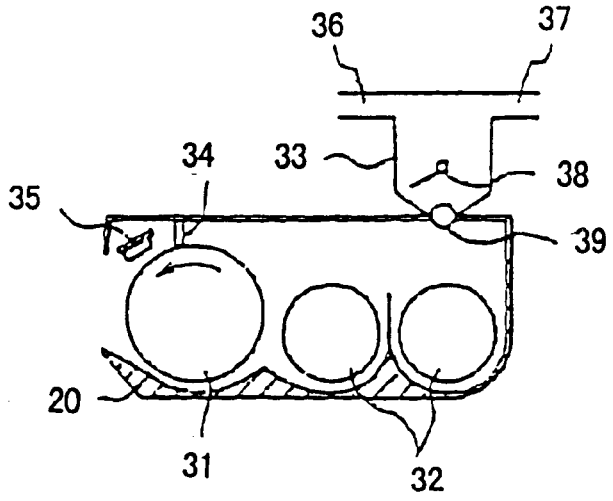
FIG. 7 shows an apparatus which demonstrates a second embodiment of the present invention.

An apparatus which demonstrates this phenomenon is shown in FIG. 7. A developing sleeve 31 in the developing device 20 rotates counterclockwise in the figure at the time of image formation. Two screws of screws 32 which agitate the carrier and toner rotate in the opposite direction from each other. From a recycled toner supplier 36 and a new toner supplier 37, both toners are supplied to a pre-agitator 33 in the developing device. The pre-agitator 33 which mixes the recycled toner with the new toner and a fin 38 which agitates the recycled toner and the new toner rotate to mix the toners. A roller 39 is located to supply toner from the pre-agitator 33 to the developing device. The sponge form roller 39 rotates to supply the toner. A measurement section 35 is located to detect a color mixture ratio.

Using the above apparatus, an experiment was performed to evaluate the performance. Toners are supplemented to the developing device, supplying magenta toner from the recycled toner supplier 36 and cyan toner from the new toner supplier 37. The developing device contains cyan toner. For convenience of evaluation, the same amount of toner is supplemented from the recycled toner side as well as from the new toner side.

Such the method of supplementing is employed to form a solid image. 100 images were formed. These images include a monochromic cyan image at first, then images with color phases gradually shifted to magenta, and finally a uniform blue image.

If the recycled toner and the new toner are directly supplied to the developing device without the use of the pre-agitator 33, magenta was partly mixed after about 10 prints and color variation was remarked in one print. After 100 prints, the whole print was gradually closer to blue and color variation was unlikely remarkable. As a result of this experiment, it was found that a small amount of the color-mixed toner on the contrary makes color variation remarkable and sufficient dispersion of the color-mixed toner is important on a color mixture ratio in practical use. It was also found that the apparatus of this embodiment could be employed to perform sufficient mixture.

Fourth Embodiment

If a mixing unit which mixes new toner with recycled toner comprises a screen-like member, it is possible to disperse and mix toners suitably without imparting strong stress on the toners.

Figure 8:
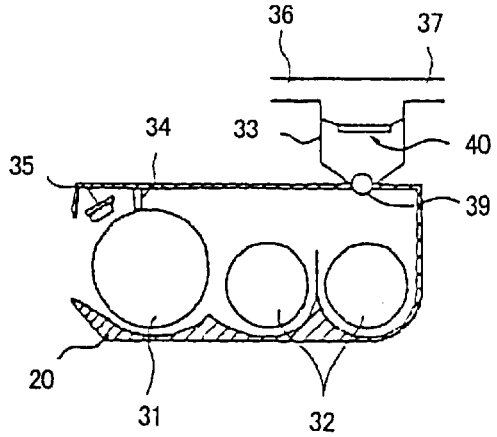
FIG. 8 shows an apparatus which experiments in a third embodiment of the present invention.

FIG. 8 shows this experimental apparatus, which has an arrangement mostly identical to the developing device in FIG. 7 and indicated with the same reference numerals. A screen 40 corresponds to the mixture of recycled toner with new toner by the fin 38 in FIG. 7. The toners supplemented from above the screen 40 are mixed through the screen 40. This is effective to finely mix both toners with merit because less mechanical stress hardly deteriorates the toner. A color mixture experiment similar to the second embodiment was performed using this apparatus. As a result, excellent color uniformity was obtained.

The apparatus of the example in FIG. 6 is employed to supply the new toner and the recycled toner individually to the developing unit. This is effective to adjust a degree of color mixture easily. Because of the individual supply, it is controllable to run supplement of a required amount of each toner and is possible to adjust a state of the toner in the developing device with a small time delay.

Fifth Embodiment

The fifth embodiment is provided with a color mixture ratio detection unit which detects a color mixture ratio of a recycled toner, a recycled toner supply amount determination section which determines a supply amount of the recycled toner based on a signal from the color mixture ratio detection unit, and a supplier which varies the supply amount of the recycled toner in accordance with determination by the toner supply amount determination section. This arrangement is effective to adjust the supply of the recycled toner based on its color mixture ratio and prevent excessive color mixture.

FIG. 9 is a block diagram which shows the fifth embodiment, which comprises a color mixture ratio detection unit 51, a recycled toner supply amount determination section 52, a recycled toner supplier 53 and a new toner supplier 54. The color mixture ratio detection unit 51 includes a sensor controller and divides degrees of color mixture of the recycled toner into several levels based on a detected signal from a sensor, sending a signal D indicating the level to the recycled toner supply amount determination section 52. The recycled toner supply amount determination section 52, based on the signal D received from the color mixture ratio detection unit 51, sends signals S1, S2 corresponding to supply amounts of the recycled toner and new toner to the recycled toner supplier 53 and the new toner supplier 54, respectively. This apparatus is possible to form an image without causing excessive color mixture when the supply amount of the recycled toner is controlled.

An example of processing in the recycled toner supply amount determination section 52 is shown. Data D indicating a color mixture ratio is fed into the recycled toner supply amount determination section 52. For the input signal D, a combination of a signal A1 corresponding to the recycled toner supply and a signal A2 corresponding to the new toner supply is selected. Selection of combination follows a table. The combination of A1 and A2 has a constant total. Selection of combination can vary a ratio between supply amounts of recycled toner and new toner.

With respect to the supply of toner, on the other hand, the total amount is determined in a device which determines the total amount of the supplemental toner, not depicted. In accordance with a value N corresponding to the total amount, data S indicative of supply amounts sent to the recycled toner supplier 53 and the new toner supplier 54 are calculated from, $$S1=A1*N$$

$$S2=A2*N$$

and sent to the recycled toner supplier 53 and the new toner supplier 54, respectively. When N corresponds to the total amount of the supplemental amount and A1, A2 are always multiplied by the same N to yield S1, S2, a supply ratio between the recycled toner and the new toner is given by A1, A2. Specifically, values of S1 and S2 correspond to time periods of rotations of the toner suppliers and are employed to control the supply amounts.

As the data D indicative of the color mixture ratio, data indicative of a reflective density of the recycled toner was employed. The reflective density of the recycled toner can be measured by a reflective density sensor 49 in FIG. 6, which sends the data D to the recycled toner supply amount determination section 52. The reflective density sensor for the recycled toner comprises a light source and a sensor which detects an amount of light.

According to the above-described arrangement, the color mixture ratio detection unit 51 comprises a device which measures the reflective density of the recycled toner, which can directly detect and accurately control the color mixture ratio. The unit which detects the color mixture ratio of the recycled toner, of a direct measurement type, is possible to obtain accurate information because of no assumption-based calculation and algorithm interposed.

Sixth Embodiment

The use of an arithmetic section (an arithmetic unit) for calculating from image signals removes the need for installing any sensor which detects and the need for ensuring a special space. This point is explained in the sixth embodiment. The color mixture ratio Pc in the recycled toner is considered with regard to the image formation section for the second color, using G for the inverse transfer rate of the toner of the first color, Sa for the image area of the first color, Sb for the image area of the second color and R for the transfer rate. An amount of toner inversely transferred to a photosensitive member of the second color in the image formation section of the second color is represented by Sa*R*G and collected by the cleaner for the second color.

With respect to image formation of the second color, an amount of the toner collected in cleaning can be given by Sb*(1−R). In this case Sa*R*G/((Sb*(1−R))+Sa*R *G) represents a color mixture ratio of the recycled toner. After time-varying n-times image formation, a value is created from Sa*R*G added n-times. This value can be employed to assume a color mixture ratio after the n-times. It is required to input the inverse transfer rate and the transfer rate in the system previously. These values may be altered based on environmental data such as temperature and humidity and time-varying data such as the number of running copies by the photosensitive member and transfer belt to improve the assumption accuracy.

This assumption is employed in detection of a color mixture ratio in the process of the arrangement shown in FIG. 9 to form an image in the apparatus shown in FIG. 1. A color order is determined as a transfer order of yellow, magenta, cyan and black to the intermediate transfer belt. Therefore, the color mixtures caused include color mixture of yellow in magenta, color mixture of magenta in cyan and color mixture of cyan in black. Evaluations were made paying attention on these color mixtures. Even after 1000 prints, color variation was not remarkable.

Seventh Embodiment

The developing unit has an arrangement as shown in FIG. 7. The density sensor 35 is employed to measure the color mixture ratio in the developing unit. In the figure, it measures the density on the developing sleeve after passing through the doctor blade 34 in the developing device. Alternatively, it may perform the measurement at a different location in the developing device. The measurement includes illuminating a light, measuring an intensity of the reflected light, and assuming a degree of color mixture.

The figure shows a two-component developing device for development, which has a mixture of carrier and toner formed in a brush by a magnetic force in the sleeve. Location of the magnets in the sleeve configures a distribution of lines of magnetic force to arrange carriers along the lines of magnetic force, resulting in standing- and lying-brush parts. The measurement is performed in the lying-brush part. If the measurement section is located inside the developing device (inside the doctor blade), the measurement device is easily contaminated. At the lying-brush part beyond the doctor blade, the carrier and toner are constrained on the sleeve and prevented from scattering to contaminate the measurement section.

Principles of the measurement include a method of measuring a normal reflection light and a method of measuring a diffused reflection light. This embodiment employs the normal reflection light. If the normal reflection light is employed, a larger noise occurs when the sleeve has a higher reflectance on the surface.

In the seventh embodiment, the sleeve surface is sandblasted and the lying-brush part with concentrated carriers can be employed for an excellent measurement. While the value from the density sensor 35 located at the position in FIG. 7 is used as data D and the apparatus shown in the fourth embodiment is employed for controlling, image formation is performed successively to obtain 1000 prints, which are found all having excellent images and less color variation.

The above color mixture ratio detection unit comprises a device which measures a color mixture ratio of toner. The device includes a light source which illuminates a light having a wavelength that exhibits a large difference in spectral reflectance between a color A and a mixed color A+B, and a photo detector which measures an intensity of the light having that wavelength. The device is possible to easily detect the color mixture ratios of the color A and the color A+B. A color phase variation due to color mixture can be detected from the difference in spectral reflectance.

Figure 10:
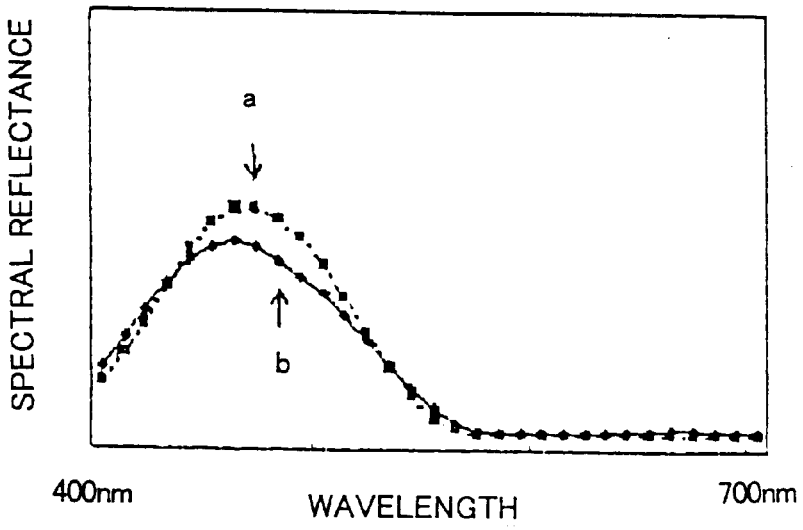
FIG. 10 shows a mixed color of magenta with cyan.
Figure 11:
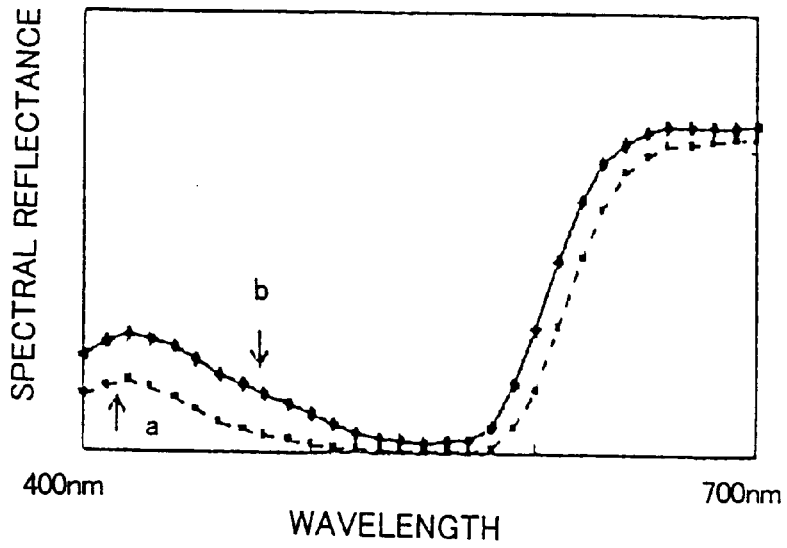
FIG. 11 shows a mixed color of yellow with magenta.

FIGS. 10 and 11 show examples of reflectance measured while varying a wavelength of a light source. FIG. 10 shows the color mixture of magenta in cyan and FIG. 11 the color mixture of yellow in magenta. The curve-a indicates the case of no color mixture and the curve-b the case of color mixture. It is found that only limited wavelengths could cause variations due to the color mixture. The light source having such the wavelength can be employed to measure a color mixture ratio from the reflectance. Methods of selecting a wavelength include a method of using a light source having a single wavelength such as a laser and a method of filtering a white light source to limit a wavelength.

Eighth Embodiment

Figure 12:
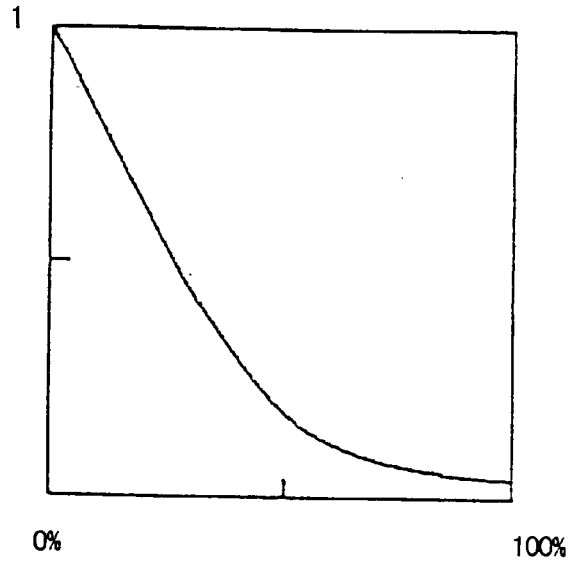
FIG. 12 shows a reflectivity measured from a mixed color of yellow with magenta.

A reflectance was measured in the case of the mixture of yellow in magenta, providing a filter which passes wavelengths shorter than 500 nm inserted into a white light source. A result is shown in FIG. 12. The horizontal axis indicates a color mixture ratio of yellow and the vertical axis indicates a value standardized on the basis of 1 for a color mixture ratio of 0%. The reflectance saturates at a color mixture ratio of about 50%. As the color mixture ratio used in process control is below 50%, there is no problem. In accordance with this graph, a color mixture ratio can be obtained from the reflectance and used as the data D indicating the color mixture ratio in the fourth embodiment to perform experiment. Using as D, Table 2 shown below is employed. This measurement 1 is classified into eight stages from 0 to 8 in Table 2, which are simply divided linearly and provided with values of D=T*8−1 where T denotes a value in this measurement. Successive prints similar to the fourth embodiment could create excellent images.

TABLE 2

| D | A1 | A2 |
|---|---|---|
| 0 | 15 | 1 |
| 1 | 13 | 3 |
| 2 | 11 | 5 |
| 3 | 9 | 7 |
| 4 | 7 | 9 |
| 5 | 5 | 11 |
| 6 | 3 | 13 |
| 7 | 1 | 15 |

Figure 13:
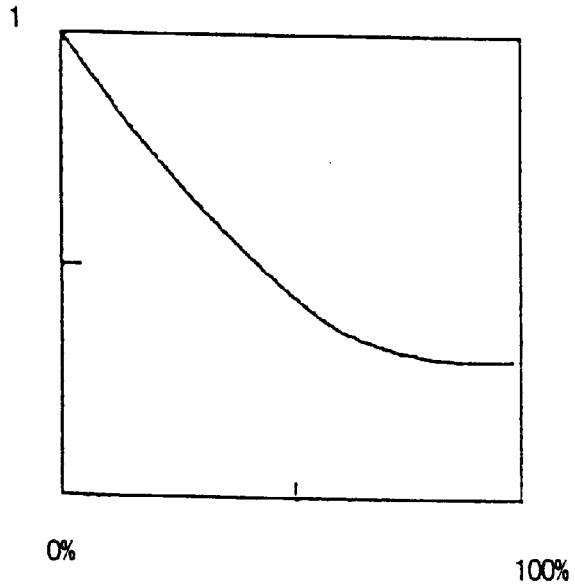
FIG. 13 shows a reflectivity measured from a mixed color of magenta with cyan.

Similarly, a reflectance was measured in the case of mixture of magenta in cyan. This result is shown in FIG. 13. The result can be employed similarly to control excellently. A short wavelength LD, LED may be employed as a light source. The measurement section 35 in the apparatus shown in FIG. 7 is equipped with a measurement device using a LD which detects a color mixture ratio. As a result, the color mixture ratio could be detected excellently.

This embodiment has an excellent effect because a color mixture ratio of toner in each developing device is below the limiting color mixture ratio and a color phase variation of an image formed can be contained within tolerance.

A recycled toner is supplied to each developing device in such a manner that a color mixture ratio of toner in the developing device is kept below the limiting color mixture ratio. Therefore, the color mixture ratio of the toner in the developing device is prevented from exceeding the limiting color mixture ratio due to an excessive supply of the recycled toner. This is an excellent effect.

The limiting color mixture ratio is determined from a combination of colors mixed in the color in the developing device. Therefore, an amount of color phase variation in an image can be contained within tolerance. This is an excellent effect.

Image formation is performed in order of a lower total of color mixture ratios relative to toners of other three colors. Therefore, a much larger amount of recycled toner can be reused. This is an excellent effect.

The limiting color mixture ratio of yellow toner to magenta toner is determined 6%. Therefore, a color phase variation in an image can be contained within tolerance. This is an excellent effect.

The limiting color mixture ratio of magenta toner to cyan toner is determined 7%. Therefore, a color phase variation in an image can be contained within tolerance. This is an excellent effect.

A supply amount of a recycled toner of each color can be determined based on a value indicating an image area of the upstream color and a recycled toner color mixture ratio calculated from the value indicating the image area of the color. Therefore, the color mixture ratio of the toner in the developing device can be controlled below the limiting color mixture ratio. This is an excellent effect.

According to the embodiment, an image formation method comprises forming a latent image on each image carrier, developing the latent image by attaching toner thereon, transferring the attached toner to an intermediate transfer member, and removing the toner resided on the intermediate transfer member after the transferring. In this method, when the second or lower order color is transferred to the intermediate transfer member, the collected recycled toner is employed for development. Therefore, it is possible to reuse the color-mixed recycled toner independent of a degree of color mixture and suppress a variation in color reproduction of the formed image.

The new toner and the recycled toner are mixed together prior to supplying them to the developing unit. Therefore, the new toner can be well mixed with the color-mixed recycled toner without causing any partial variation of color mixture in toner.

The new toner and the recycled toner are supplied through different supply ports. Therefore, they can be mixed reliably without causing any partial variation of color mixture.

The method further comprises detecting a color mixture ratio of the recycled toner, determining supply amounts of the recycled toner and the new toner based on the detected result, and varying the supply amounts of the recycled toner and the new toner in accordance with the determination. Therefore, it is possible to avoid excessive color mixture.

The new toner and the recycled toner are supplied at a certain ratio at timing required for supplying toner. Therefore, it is possible to hold a constant amount of toner to be contained in a developing unit.

The method further comprises detecting a color mixture ratio of the recycled toner, determining supply amounts of the recycled toner and the new toner based on the detected result, and varying the supply amounts of the recycled toner and the new toner in accordance with the determination. Therefore, it is possible to avoid excessive color mixture.

The method further comprises illuminating a toner of a mixed color A+B with a light having a wavelength that exhibits a large difference in spectral reflectance between a color A and the mixed color A+B, measuring an intensity of a reflected light with a photodetector, and comparing the intensity with reflectance data of a color A+B having a known color mixture ratio to determine the color mixture ratio. Therefore, it is possible to easily detect mixture of color A with color B.

According to the embodiment, it is possible to suppress reduction in image quality due to color mixture of a plurality of toners. Therefore, an image formation apparatus is provided, which can effectively reuse the collected toner as a recycled toner. This is an excellent effect.

According to the embodiment, an image formation apparatus comprises a plurality of image carriers, a charging and exposing unit which forms electrostatic latent images on the image carriers, a developing unit which attaches toners to the formed electrostatic latent images to develop the electrostatic latent images, a transferring unit which transfers the attached toner to an intermediate transfer member, a cleaning unit which removes toners attached on the intermediate transfer member after passing through the transferring unit, a path unit which returns recycled toners collected by the cleaning unit to the developing unit at the time of transferring toner images on the intermediate transfer member at the second or lower transfer order, and a path unit which supplies new toners to the developing unit. Therefore, it is possible to use the recycled toner by an amount adjusted relative to the new toner. In addition, it is possible to reuse the color-mixed recycled toner independent of a degree of the color mixture and control a variation in color reproduction of the formed image.

The method further comprises a mixing unit which mixes the new toner and the color-mixed recycled toner prior to supplying them to the developing unit. Therefore, the new toner can be well mixed with the color-mixed recycled toner without causing any partial variation of color mixture in toner.

The unit which mixes the new toner and the color-mixed recycled toner includes a screen-like member. Therefore, it is possible to perform reliable mixture and prevent any partial variation of color mixture from occurring.

The unit which supplies the new toner and the color-mixed recycled toner individually to the developing unit is provided to easily adjust a degree of color mixture.

The apparatus further comprises a color mixture ratio detection unit which detects a color mixture ratio of the recycled toner, a toner supply amount determination unit which determines supply amounts of the recycled toner and the new toner based on a signal from the color mixture ratio detection unit, and suppliers which varies the supply amounts of the recycled toner and the new toner in accordance with determination by the toner supply amount determination unit. Therefore, it is possible to avoid excessive color mixture.

The unit which detects the color mixture ratio of the recycled toner comprises a device which measures a reflective density of a recycled toner. Therefore, it is possible to directly detect the color mixture ratio of the recycled toner and increase accuracy on determination of the supply amount.

The color mixture ratio detection unit comprises an arithmetic unit which computes a color mixture ratio based on an image signal. Therefore, it is possible to remove the need for measurement to detect a color mixture ratio and the need for a special space to be ensured.

The new toner and the recycled toner are supplied to the developing unit at a constant ratio. Therefore, an excellent image can be obtained with a simple arrangement for using the recycled toner and the new toner.

The apparatus further comprises a color mixture ratio detection unit which detects a color mixture ratio of a toner in the developing unit, a toner supply amount determination unit which determines supply amounts of the recycled toner and the new toner based on a detected signal from the color mixture ratio detection unit, and suppliers which varies the supply amounts of the recycled toner and the new toner in accordance with determination by the toner supply amount determination unit. Therefore, it is possible to avoid excessive color mixture.

The color mixture ratio detection unit comprises a device which measures a reflective density on a developing sleeve contained in a developing unit. Therefore, it is possible to detect the color mixture ratio of the developing unit accurately and increase accuracy on adjustment.

The device includes a light source which illuminates a light having a wavelength that exhibits a large difference in spectral reflectance between a color A and a mixed color A+B, and a photodetector which measures an intensity of the light having that wavelength. Therefore, it is possible to detect mixture of color A with color B.

The present document incorporates by reference the entire contents of Japanese priority documents, 2001-174589 filed in Japan on Jun. 8, 2001 and 2001-201509 filed in Japan on Jul. 2, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation method, comprising:

a latent image formation step of forming a plurality of latent images, sequentially on an image carrier, corresponding to a plurality of image colors for forming an image;

a development step of supplying a plurality of specific color toners corresponding to the image colors, onto the formed latent images, from a plurality of developing devices holding the plurality of specific color toners therein, to develop the formed latent images into toner images;

a image formation step of sequentially transferring the toner images to be superimposed on a recording material to form a multicolored image;

a recycle step of collecting specific color toners resided after transferring the toner images on the image carrier and reusing the collected toners once returned to the developing devices as recycled toners; and a control step of controlling a mixture ratio of the recycled toner to the specific color toner in each of the developing devices below a limiting color mixture ratio, which is defined as a mixture ratio of a recycled toner to a specific color toner in a developing device when a tone variation in image is still on a permissible limitation level, which tone variation is caused from mixture of the recycled toner into the specific color toner in the developing device at the recycle step.

2. The image formation method according to claim 1, wherein the control step includes controlling an amount of a recycled toner returned to each of the developing devices to retain a color mixture ratio of the recycled toner to the specific color toner in each of the developing devices below the limiting color mixture ratio.

3. The image formation method according to claim 2, the control step including:

deriving a color mixture ratio of a recycled toner to a specific color toner in each developing device when the recycled toner is returned to each developing device, on the basis of a color mixture ratio of a different color toner to each recycled toner, computed from a value indicating an image area of a toner image transferred onto the recording material at an earlier order, and a color mixture ratio of a recycled toner to a specific color toner in each developing device before the recycled toner is returned to the developing device; and determining a supply amount of each recycled toner returned to the developing device on the basis of the derived result to keep a color mixture ratio of a recycled toner to a specific color toner in each developing device below the limiting color mixture ratio.

4. The image formation method according to claim 1, wherein the limiting color mixture ratio is previously determined on each combination of a color of a specific color toner corresponding to and contained in a developing device and a color of a recycled toner.

5. The image formation method according to claim 4, wherein the color toner image formed from the specific color toner corresponding to and contained in a developing device is transferred onto the recording material in order of lower total of limiting color mixture ratios of each specific color toner to other color toners in each of the developing devices.

6. The image formation method according to claim 4, wherein the limiting color mixture ratio of a yellow toner to a magenta toner is determined 6% in the specific color toners.

7. The image formation method according to claim 4, wherein the limiting color mixture ratio of a magenta toner to a cyan toner is determined 7% in the specific color toners.

8. An image formation method, comprising:

charging and exposing surfaces of a plurality of image carriers to form electrostatic latent images thereon;

attaching specific color toners corresponding to the image carriers onto the electrostatic latent images to develop the electrostatic latent images;

transferring the developed images to be superimposed on an intermediate transfer member to form toner images on the intermediate transfer member;

transferring the toner images on a recording sheet;

cleaning the image carriers to remove specific color toners resided thereon using cleaning devices contained in the image carriers;

detecting a color mixture ratio of the recycled toner;

determining supply amounts of the recycled toner and the new toner based on a signal of the color mixture ratio detected;

varying the supply amounts of the recycled toner and the new toner; and forming toner images on the intermediate transfer member at the second or lower transfer order using recycled toners collected by the cleaning devices together with new toners.

9. The image formation method according to claim 8, wherein the recycled toner collected by the cleaning device is mixed with a new toner and supplied to the developing device.

10. The image formation method according to claim 9, wherein the new toner and the recycled toner are supplied to the developing unit through different supply ports.

11. The image formation method according to claim 10, wherein the new toner and the recycled toner are supplied to the developing unit at a certain ratio when it is required to supply a toner to the developing unit.

12. The image formation method according to claim 8, further comprising:

illuminating a toner of a mixed color A+B with a light having a wavelength that exhibits a large difference in spectral reflectance between a color A and the mixed color A+B;

measuring an intensity of a reflected light with a photodetector; and comparing the intensity with reflectivity data of a color A+B having a known color mixture ratio to determine the color mixture ratio.

13. The image formation method according to claim 8, further comprising:

detecting a mixed color ratio of a toner contained in the developing unit;

determining a supply amount of the recycled toner based on the color mixture ratio detected; and varying the supply amount of the recycled toner.

14. The image formation method according to claim 13, further comprising:

illuminating a toner of a mixed color A+B with a light having a wavelength that exhibits a large difference in spectral reflectance between a color A and the mixed color A+B;

measuring an intensity of a reflected light with a photodetector; and comparing the intensity with reflectivity data of a color A+B having a known color mixture ratio to determine the color mixture ratio.

15. An image formation apparatus, comprising:

an image carrier which carries a plurality of latent images formed thereon corresponding to different colors in a colored image of at least two colors;

a plurality of developing devices which supplies specific color toners corresponding to image colors to develop the latent images formed on the image carrier;

a transferring unit which sequentially transfers color toner images, developed on the image carrier using the specific color toners in the developing devices, to be superimposed on a recording sheet;

a cleaning unit which collects toners not transferred and resided on the image carrier after transferring the toner images;

a toner conveying unit which returns the toners collected by the cleaning unit to the developing devices; and a control unit which controls a mixture ratio of the recycled toner to the specific color toner in each of the developing devices below a limiting color mixture ratio, which is defined as a mixture ratio of a recycled toner to a specific color toner in a developing device when a tone variation in image is still on a permissible limitation level, which tone variation is caused from mixture of the recycled toner into the specific color toner in the developing device at the recycle step of collecting specific color toners resided after transferring the toner images on the image carrier and reusing the collected toners once returned to the developing devices as recycled toners.

16. An image formation apparatus, comprising:

a plurality of image carriers;

a charging and exposing unit which forms electrostatic latent images on the image carriers based on image signals;

a developing unit which attaches specific color toners to the electrostatic latent images on the image carriers to develop the electrostatic latent images into toner images;

a transferring unit which transfers the toner images sequentially onto an intermediate transfer member;

a cleaning unit which removes toners not attached on the intermediate transfer member after the transferring;

a path unit which returns recycled toners collected by the cleaning unit to the developing unit at the time of transferring toner images on the intermediate transfer member at the second or lower transfer order;

a path unit which supplies new toners to the developing unit;

a color mixture ratio detection unit which detects a color mixture ratio of a specific color in the recycled toner;

a toner supply amount determination unit which determines supply amounts of the recycled toner and the new toner based on a signal from the color mixture ratio detection unit; and suppliers which vary the supply amounts of the recycled toner and the new toner in accordance with determination by the toner supply amount determination unit.

17. The image formation apparatus according to claim 16, further comprising a mixing unit which mixes the new toner and the recycled toner prior to supplying them to the developing unit.

18. The image formation apparatus according to claim 17, wherein the mixing unit includes a screen-like member.

19. The image formation apparatus according to claim 16, further comprising a unit which supplies the new toner and the recycled toner individually to the developing unit.

20. The image formation apparatus according to claim 19, wherein the new toner and the recycled toner are supplied at a constant ratio to the developing unit.

21. The image formation apparatus according to claim 16, wherein the color mixture ratio detection unit of the toner comprises a device which measures a color mixture ratio of toner, the device including a light source which illuminates a light having a wavelength that exhibits a large difference in spectral reflectance between a color A and a mixed color A+B, and a photodetector which measures an intensity of the light having the wavelength.

22. The image formation apparatus according to claim 16, wherein the color mixture ratio detection unit comprises a device which measures a reflective density of the recycled toner.

23. The image formation apparatus according to claim 22, wherein the color mixture ratio detection unit comprises a device which measures a color mixture ratio of toner, the device including a light source which illuminates a light having a wavelength that exhibits a large difference in spectral reflectance between a color A and a mixed color A+B, and a photodetector which measures an intensity of the light having the wavelength.

24. The image formation apparatus according to claim 16, wherein the color mixture ratio detection unit comprises an arithmetic unit which computes a color mixture ratio based on an image signal.

25. An image formation apparatus, comprising:

a plurality of image carriers;

a charging and exposing unit which forms electrostatic latent images on the image carriers based on image signals;

a developing unit which attaches specific color toners to the electrostatic latent images on the image carriers to develop the electrostatic latent images into toner images;

a transferring unit which transfers the toner images sequentially onto an intermediate transfer member;

a cleaning unit which removes toners not attached on the intermediate transfer member after the transferring;

a path unit which returns recycled toners collected by the cleaning unit to the developing unit at the time of transferring toner images on the intermediate transfer member at the second or lower transfer order;

a path unit which supplies new toners to the developing unit;

a color mixture ratio detection unit which detects a color mixture ratio of a toner in the developing unit;

a toner supply amount determination unit which determines supply amounts of the recycled toner and the new toner based on a detected signal from the color mixture ratio detection unit; and suppliers which vary the supply amounts of the recycled toner and the new toner in accordance with determination by the toner supply amount determination unit.

26. The image formation apparatus according to claim 25, wherein the color mixture ratio detection unit comprises a device which measures a color mixture ratio of toner, the device including a light source which illuminates a light having a wavelength that exhibits a large difference in spectral reflectance between a color A and a mixed color A+B, and a photodetector which measures an intensity of the light having the wavelength.

27. The image formation apparatus according to claim 25, wherein the color mixture ratio detection unit comprises a device which measures a reflective density on a developing sleeve contained in the developing unit.

28. The image formation apparatus according to claim 27, wherein the color mixture ratio detection unit comprises a device which measures a color mixture ratio of toner, the device including a light source which illuminates a light having a wavelength that exhibits a large difference in spectral reflectance between a color A and a mixed color A+B, and a photodetector which measures an intensity of the light having the wavelength.

* * * * *